US009035560B2

(12) United States Patent
Li et al.

(10) Patent No.: US 9,035,560 B2
(45) Date of Patent: May 19, 2015

(54) LED DRIVING CONTROL CIRCUIT AND LED DRIVING CIRCUIT

(75) Inventors: Hai-Po Li, Wuxi (CN); Shian-Sung Shiu, New Taipei (TW); Li-Min Lee, New Taipei (TW)

(73) Assignee: Green Solution Technology Co., Ltd., New Taipei (TW)

( * ) Notice: Subject to any disclaimer, the term of this patent is extended or adjusted under 35 U.S.C. 154(b) by 761 days.

(21) Appl. No.: 13/348,628

(22) Filed: Jan. 11, 2012

(65) Prior Publication Data

US 2012/0176050 A1 Jul. 12, 2012

Related U.S. Application Data

(63) Continuation-in-part of application No. 13/241,299, filed on Sep. 23, 2011, now Pat. No. 8,664,884.

(30) Foreign Application Priority Data

Jan. 12, 2011 (CN) ..... 2011 1 0021868

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 33/08*** | (2006.01) |

(52) U.S. Cl.

CPC ..... *H05B 33/0845* (2013.01); *H05B 33/0815* (2013.01); *H05B 33/0818* (2013.01); *H05B 33/0827* (2013.01)

(58) Field of Classification Search

None

See application file for complete search history.

(56) References Cited

U.S. PATENT DOCUMENTS

| | | | | |
|---|---|---|---|---|
| 7,315,095 | B2 * | 1/2008 | Kagemoto et al. | 307/39 |
| 8,120,283 | B2 * | 2/2012 | Tanaka et al. | 315/307 |
| 8,169,161 | B2 * | 5/2012 | Szczeszynski et al. | 315/308 |
| 2008/0094008 | A1 * | 4/2008 | Liu | 315/294 |
| 2010/0110059 | A1 * | 5/2010 | Kang et al. | 345/211 |

FOREIGN PATENT DOCUMENTS

| | | | |
|---|---|---|---|
| CN | 1972541 | A | 5/2007 |
| CN | 101379887 | A | 3/2009 |
| CN | 101489335 | A | 7/2009 |

* cited by examiner

*Primary Examiner* — Anh Tran

(74) *Attorney, Agent, or Firm* — CKC & Partners Co., Ltd.

(57) ABSTRACT

The present invention provides an LED (Light-Emitting Diode) driving control circuit for controlling a converting circuit to transform an input power source into an output voltage for driving an LED module. The LED module has a plurality of LED strings. The LED driving control circuit includes a voltage detecting circuit and a feedback control circuit. The voltage detecting circuit has a plurality of detection circuits, and each detection circuit is coupled to a terminal of the corresponding LED string to determine whether a voltage of the terminal is higher or lower than a preset value. The voltage detecting circuit generates a feedback signal according to the determination results. The feedback control circuit controls the converting circuit to modulate the output voltage according to the feedback signal.

15 Claims, 5 Drawing Sheets

LED DRIVING CONTROL CIRCUIT AND LED DRIVING CIRCUIT

RELATED APPLICATIONS

The present application is a Continuation-in-part of U.S. Application No. 13/241,299, filed on Sep. 23, 2011, which was based on, and claims priority from, China Patent Application Serial Number 201110021868.6, filed Jan. 12, 2011, the disclosure of which is hereby incorporated by reference herein in its entirely.

BACKGROUND OF THE INVENTION (1) Field of the Invention

This invention relates to an LED (Light-Emitting Diode) driving control circuit and an LED driving circuit, and more particularly relates to a an LED driving control circuit and an LED driving circuit with high conversion efficiency.

(2) Description of the Prior Art

Because of the properties of long lifetime, high luminance efficiency, and fast and steady illumination, etc., an LED has been broadly accepted as a main trend of light sources for the next generation in recent years. The LEDs can be used in various applications, including indoor lighting, outdoor lighting, and commercial advertisement lighting, etc., and thus the existing light sources are gradually replaced by the LEDs. It is an important issue regarding how to make the LEDs generate illumination with steady brightness and uniform color and to provide proper protection to the LEDs so as to exhibit the lighting advantages of the LEDs.

FIG. 1 is a circuit diagram of a typical LED driving circuit. As shown in FIG. 1, the LED driving circuit includes a feedback control circuit 100, a converting circuit 110, and an LED module 120. The converting circuit 110 is coupled to an input power source VIN for converting the input power source VIN into an output voltage VOUT to drive the LED module 120 for illumination. The conversion operation performed by the converting circuit 110 may be a step-up conversion or a step-down conversion. Take a DC-to-DC boost converting circuit as an example. The converting circuit 110 includes an inductor L1, a transistor SW1, a rectifying diode K1, and an output capacitor C1. The inductor L1 has one end coupled to the input power source VIN and the other end coupled to the transistor SW1, and an inductor current IL1 flows through the inductor L1. The transistor SW1 has one end coupled to the inductor L1 and another end coupled to the ground through a resistor R1. The output capacitor C1 has one end coupled to a junction between the inductor L1 and the transistor SW1 through the rectifying diode K1 and the other end grounded. The LED module 120 has a plurality of LED strings connected in parallel. To make sure a substantially identical current flowing through each of the LED units in the LED module 120, a current balancing unit 130 with a plurality of current balancing ends D1-Dn coupled to the corresponding LED strings in the LED module 120 is used for balancing the current of each of the LED strings, so as to have the current stabilized at a predetermined current value. The driving voltages of the current balancing ends D1-Dn should be maintained at or above a lowest operable voltage level to make sure that the current balancing unit 130 works normally. For detecting the driving voltage, a voltage detecting circuit 140 is used and is coupled to the current balancing ends D1-Dn for detecting the level of the current balancing ends D1-Dn, which would be varied in response to the variations of voltage difference on the LED strings through while a current with the predetermined current value flows. To have the current balancing ends D1-Dn at or above a lowest operable voltage level, the voltage detecting circuit 140 generates a feedback signal Fb1 according to the level of the current balancing end which has the lowest level among all the current balancing ends D1-Dn. The feedback control circuit 100 controls the converting circuit 110 to generate the output voltage VOUT according to the feedback signal Fb1 to maintain all the current at or above the predetermined current value. The current balancing unit 130 also receives a dimming signal DIM and starts or stops the current flowing through the LED module 120 according to the dimming signal DIM for the burst dimming control. The voltage detecting circuit 140 may have a plurality of diodes, and each diode has a negative end coupled to the corresponding current balancing end D1-Dn and a positive end coupled to a common driving power source VCC through the same resistor.

The feedback control circuit 100 includes a feedback unit 150 and a pulse width control unit 160. The feedback unit 150 includes an amplifying unit 152 and a compensation unit 154. The amplifying unit 152 receives the feedback signal Fb1 and a reference signal Vr1 so as to generate an output signal. The output signal is then compensated by the compensation unit 154, so as to generate a pulse width control signal Vea1. The pulse width control unit 160 includes a pulse width modulation unit 162 and a driving unit 164. The pulse width modulation unit 162 receives the pulse width control signal Vea1 and a ramp signal so as to generate a pulse width modulation signal S1. The driving unit 164 receives the pulse width modulation signal S1 and the dimming signal DIM, and accordingly generates a control signal Sc1.

However, the voltage detecting circuit 140 is composed of discrete components, and thus a size and cost of a PCB of the LED driving circuit are increased, as well as labor cost and assembly complexity.

SUMMARY OF THE INVENTION

In view of the foregoing problem, the present invention provides an LED driving control circuit with a built-in voltage detecting circuit, wherein the LED driving control circuit is integrated in a single chip, and thus an LED driving circuit using the LED driving control circuit is relatively simple and with low cost. The present invention also adapts the period right after the dimming signal is changed from "OFF" state to "ON" state to enhance the output power of the converting circuit so as to have the current on the LED module be rapidly stabilized at the predetermined current value.

In order to achieve the aforementioned object, the present invention provides an LED driving control circuit for controlling a converting circuit to convert a power from a power source into an output voltage to drive an LED (Light-Emitting Diode) module. The LED module has a plurality of LED strings. The LED driving control circuit comprises a voltage detecting circuit and a feedback control circuit. The voltage detecting circuit has a plurality of detection circuits. Each of the detection circuits is coupled to a terminal of a corresponding LED string in the LED module for determining whether the terminal has a value higher or lower than a preset value. The voltage detecting circuit generates a feedback signal in response to the determination result. The feedback control circuit controls the converting circuit to modulate the output voltage according to the feedback signal.

The present invention also provides an LED driving circuit adapted for driving an LED module which has a plurality of LED strings. The LED driving circuit comprises a converting circuit, a current balance unit, and an LED driving control circuit. The converting circuit is coupled to the LED module for receiving at least one control signal to convert an input voltage into an output voltage to drive the LED module. The current balance unit is coupled to the LED strings for balancing currents of the LED strings. The LED driving control circuit comprises a plurality of detection circuits. Each of the detection circuits is coupled to a terminal of a corresponding LED string for determining whether the terminal is higher or lower than a preset value. The LED driving control circuit generates the control signal for controlling the converting circuit to modulate the output voltage.

BRIEF DESCRIPTION OF THE DRAWINGS

The present invention will now be specified with reference to its preferred embodiment illustrated in the drawings, in which.

DESCRIPTION OF THE PREFERRED EMBODIMENT

Figure 2:
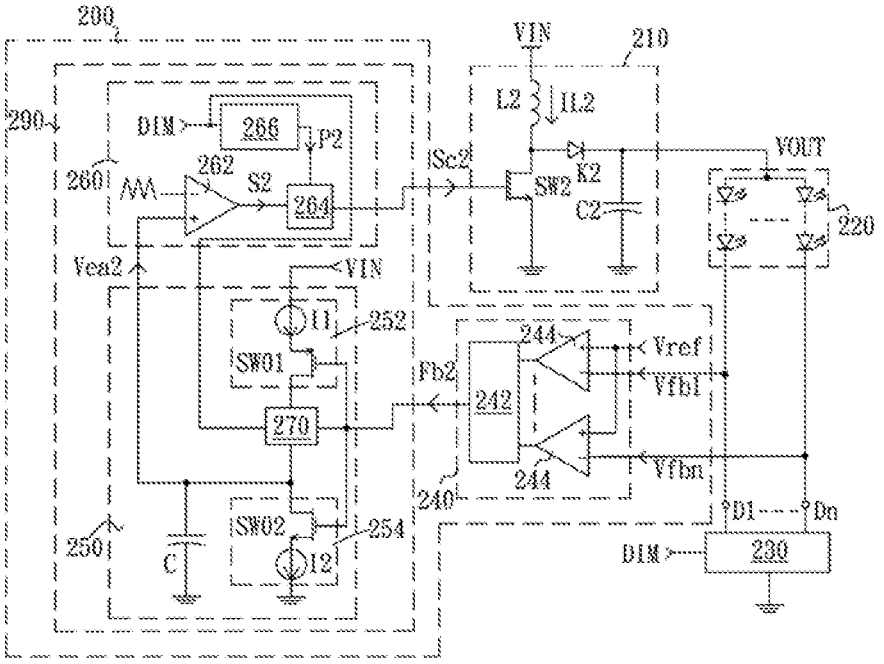
FIG. 2 is a circuit diagram of an LED driving circuit in accordance with a first preferred embodiment of the present invention.

FIG. 2 is a circuit diagram of an LED driving circuit in accordance with a first preferred embodiment of the present invention. As shown in FIG. 2, the LED driving circuit includes an LED driving control circuit 200 and a converting circuit 210. The LED driving control circuit 200 comprises a voltage detecting circuit 240 and a feedback control circuit 290, and is utilized for controlling the converting circuit 210 to convert a power from a power source to drive an LED module 220. The LED module 220 has a plurality of LED strings connected in parallel. The converting circuit 210 is coupled to an input power source VIN for converting (such as boost converting or buck converting) the input power source VIN into an output voltage VOUT according to a control signal Sc2 generated by the feedback control circuit 290 to drive the LED module 220 for illumination.

In the present embodiment, the converting circuit 210 is a DC-to-DC boost converting circuit, which includes an inductor L2, a transistor SW2, a rectifying diode K2, and an output capacitor C2. The inductor L2 has one end coupled to the input power source VIN and the other end coupled to one end of the transistor SW2, wherein an inductor current IL2 flows through the inductor L2. The transistor SW2 has one end coupled to the inductor L2 and another end grounded. The output capacitor C2 has one end coupled to a junction between the inductor L2 and the transistor SW2 through the rectifying diode K2, and the other end grounded.

To make sure that an identical steady current is generated and flows through each of the LED units in the LED module 220, a current balancing unit 230 with a plurality of current balancing ends D1-Dn is used. The current balancing ends D1-Dn are coupled to the corresponding LED strings in the LED module 220 for balancing the current flowing through the LED strings, so as to have the current be stabilized at a predetermined current value. The driving voltages for generating a current flow with the predetermined current value on the LED strings are usually different, because of the variety of LED units that have different threshold voltages. Thus, the current balancing ends D1-Dn may show different voltage levels. The levels of the current balancing ends D1-Dn should be maintained at or above a lowest operable level for guaranteeing the current balancing unit 230 working normally to maintain the currents flowing through each of the LED strings at the predetermined current value.

For the aforementioned purpose, a voltage detecting circuit 240 is added in the present embodiment. The voltage detecting circuit 240 has a plurality of detection circuits 244 and a logical unit 242. The detection circuits 244 are respectively coupled to the current balancing ends D1-Dn for receiving voltage signals Vfb1-Vfbn indicative of terminal levels of the LED strings and so determine whether the terminal levels are higher than a preset value or lower than the preset value. The logical unit 242 generates the feedback signal Fb2 to the feedback control circuit 290 according to the output signals of the detection circuits 244, and thus the feedback signal Fb2 is changed between a first logical level and a second logical level in response to the determination results of the detection circuits 244. In the following, the first logical level is called as high level, and the second logical level is called as low level.

The feedback control circuit 290 includes a feedback unit 250 and a pulse width control unit 260, and is utilized for generating a control signal Sc2 according to the feedback signal Fb2 to control the converting circuit 210 to convert the input power source VIN into an appropriate output voltage VOUT to drive the LED module 220. The feedback unit 250 receives the feedback signal Fb2 representing the condition of the LED module 220 and generates a pulse width control signal Vea2 accordingly. The feedback unit 250 includes a charging unit 252, a discharging unit 254, a compensating capacitor C, and a dimming adjusting unit 270. The charging unit 252 has a first current source I1 serially connected to a first switch SW01, and the discharging unit 254 has a second current source I2 serially connected to a second switch SW02, and the charging unit 252 and the discharging unit 254 are coupled to the compensating capacitor C.

As the level of any one of the current balancing ends D1-Dn is lower than the reference voltage Vref, the feedback signal Fb2 is at a low level to enable the first current source I1 to charge the compensating capacitor C through the conducted first switch SW01. On the other hand, as the levels of all the current balancing ends D1-Dn are higher than the reference voltage Vref, the feedback signal Fb2 is at a high level to enable the second current source I2 to discharge the compensating capacitor C through the conducted second switch SW02.

The pulse width control unit 260 includes a pulse width modulation unit 262, a dimming control unit 266, and a driving unit 264, and is utilized for adjusting a duty cycle of the control signal Sc2 according to the pulse width control signal Vea2 generated by the compensating capacitor C. The pulse width modulation unit 262 may be a comparator with an inverting input for receiving the pulse width control signal Vea2 and a non-inverting input for receiving a ramp signal, so as to generate and output a pulse width modulation signal S2 to the driving unit 264. The dimming control unit 266 receives the dimming signal DIM and generates a dimming control signal P2 with periodic pulses when the dimming signal DIM is in the second state representing "OFF", and generates a high level dimming control signal P2 when the dimming signal DIM is in the first state representing "ON". The driving unit 264 receives the pulse width modulation signal S2 and the dimming control signal P2. When the dimming signal DIM is in the first state, the driving unit 264 generates the control signal Sc2 according to the pulse width modulation signal S2 to make the LED module 220 generate steady illumination. When the dimming signal DIM is in the second state, the driving unit 264 generates the control signal Sc2 with a smallest duty cycle according to the dimming control signal P2. Meanwhile, the current balancing unit 230 also stops the current flowing through the LED module 220 according to the dimming signal DIM, so as to make the LED module 220 stop generating illumination. Thereby, the feedback control circuit 290 is capable of controlling the converting circuit 210 executing a minimum amount of power transmission to compensate power loss due to the leakage current or other circuit problems. Thus, the level of the output voltage VOUT generated by the converting circuit 210 can be maintained within a range close to the level when the dimming signal DIM is in the first state.

The dimming adjusting unit 270 is connected between the first switch SW01 and the compensating capacitor C for adjusting a level of the pulse width control signal Vea2 according to the dimming signal DIM. Within a period right after the dimming signal DIM is changed from the second state to the first state, the dimming adjusting unit 270 enhances the level of the pulse width control signal Vea2 with a predetermined level, so as to increase the duty cycle of the control signal Sc2 by a responded predetermined value for quickly enhancing the output power of the converting circuit 210. Accordingly, the current flowing through the LED module 220 will be rapidly rebounded to the predetermined current value right after the dimming signal DIM is changed from the second state to the first state, thereby improving the problem of imprecise dimming control.

Figure 3:
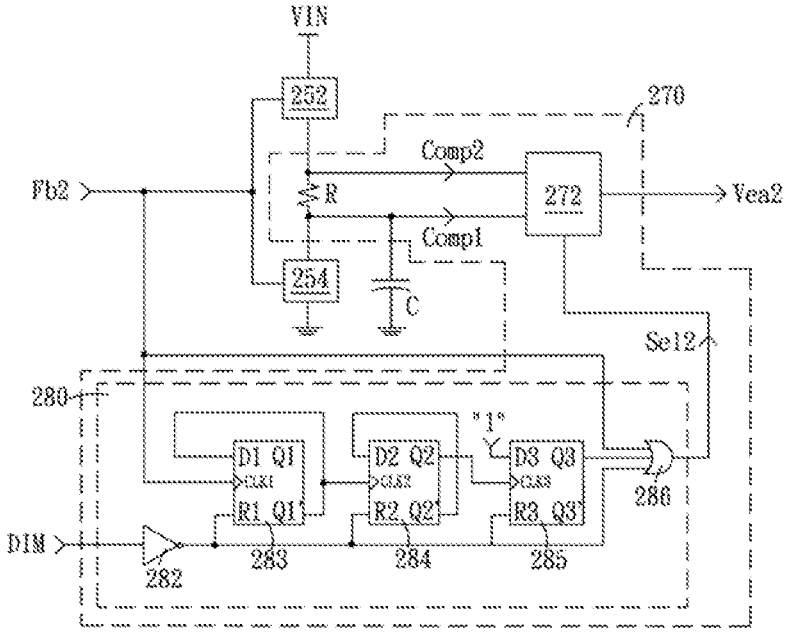
FIG. 3 is a circuit diagram of a dimming adjusting unit of FIG. 2 in accordance with a preferred embodiment of the present invention.

FIG. 3 is a circuit diagram of a dimming adjusting circuit of FIG. 2 in accordance with a preferred embodiment of the present invention. Also referring to FIG. 2, the dimming adjusting unit 270 includes a level difference generating unit R, a selection unit 272, and a level adjusting unit 280. The level difference generating unit R is coupled between the charging unit 252 and the discharging unit 254 for generating a first level signal Comp1 at a low side end and a second level signal Comp2 at a high side end, and the low side end of the level difference generating unit R is also coupled to the compensating capacitor C. The level adjusting unit 280 includes an inverter 282, a first D flip-flop 283, a second D flip-flop 284, a third D flip-flop 285 and an OR gate 286. The level adjusting unit 280 generates a selecting signal Sel2 according to the dimming signal DIM. The selection unit 272 receives the selecting signal Sel2, and accordingly selects one of the first level signal Comp1 and the second level signal Comp2 as the pulse width control signal Vea2.

The first D flip-flop 283 has a clock input CLK1 for receiving the feedback signal Fb2 and a data input D1 coupled to an output Q1' thereof. The output Q1' is also coupled to a clock input CLK2 of the second D flip-flop 284 to control the operation of the second D flip-flop 284. The second D flip-flop 284 has an input D2 coupled to an output Q2' thereof, and an output Q2 of the second D flip-flop 284 is coupled to a clock input CLK3 of the third D flip-flop 285. An input D3 of the third D flip-flop 285 receives a high level signal, which can be regarded as the binary digital signal "1".

The dimming signal DIM is fed into the inverter 282, and an inverted signal is generated to the reset inputs R1, R2, R3 of the three D flip-flops 283, 284, 285. Accordingly, as the dimming signal DIM is in the second state of low level, the output signals of the three D flip-flops 283, 284, 285 are reset to the low level.

Figure 5:
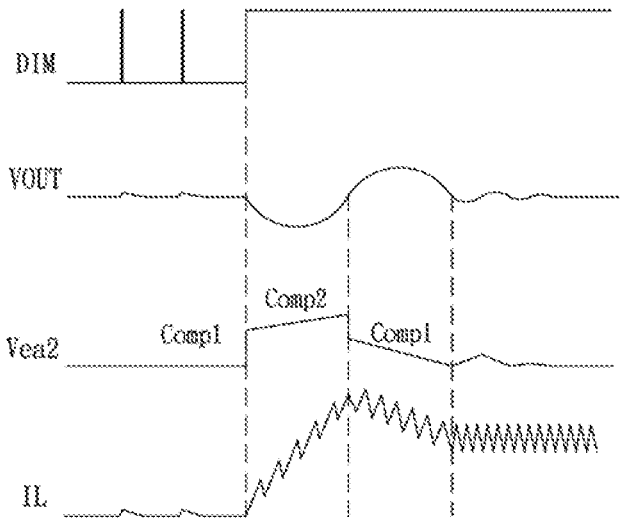
FIG. 5 is a diagram of waveforms showing the signals related to dimming control of the LED driving circuit of FIG. 3.

The OR gate 286 receives the feedback signal Fb2, the output signal of the third D flip-flop 285 and the inverted signal of the dimming signal DIM so as to output the selection signal Sel2. As shown in FIG. 5, when the dimming signal DIM is in the second state, the first D flip-flop 283, the second D flip-flop 284 and the third D flip-flop 285 are reset, and the selection signal Sel2 is at the high level. At this time, the selection unit 272 selects the first level signal Comp1 as the pulse width control signal Vea2. In the period right after the dimming signal DIM is changed from the second state to the first state, the output voltage VOUT drops to the level below a normal operation voltage at first because of the insufficiency of inductor current IL2, and thus a low level feedback signal Fb2 is generated. Meanwhile, the first current source I1 of the charging unit 252 charges the compensation capacitor C, and the output signal of the third flip-flop 285 will stay at the low level to generate the low level selection signal Sel2, so as to enable the selection unit 272 to select the second level signal Comp2 as the pulse width control signal Vea2. Since the relationship between the first level signal Comp1 and the second level signal Comp2 is: Comp2=Comp1+I1×R, the pulse width control signal Vea2 is enhanced with a level which is equal to the current of the first current source I1 times the resistance of the level difference generating unit R right after the dimming signal DIM is changed from the second state to the first state. Accordingly, the duty cycle of the control signal Sc2 is immediately increased to rapidly increase the inductor current IL2, so as to rapidly enhance the level of the output voltage VOUT to the normal operation voltage.

Figure 1:
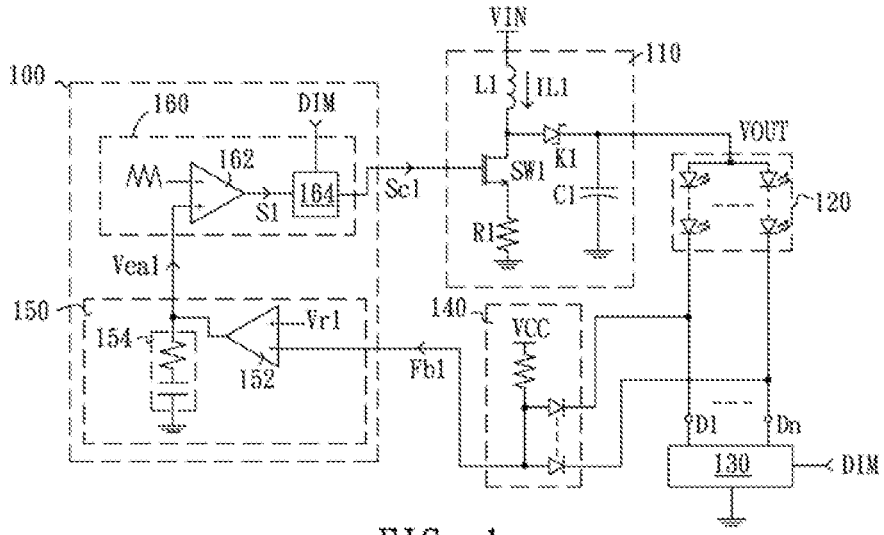
FIG. 1 (RELATED ART)
FIG. 1 is a circuit diagram of a typical LED driving circuit.

Then, the feedback signal Fb2 is changed to the high level to trigger the third D flip-flop 285 to output the high level signal, so as to enable the selection unit 272 to select the first level signal Comp1 as the pulse width control signal Vea2 again. The selection remains until the dimming signal DIM is changed from the second state to the first state. In the present embodiment, because of noise, the voltage detecting circuit 240 may generate a short period high level signal as the feedback signal Fb2 right after the dimming signal DIM is changed from the second state to the first state. In order to prevent the error resulted from the short period high level signal, the level adjusting unit 280 changes the selection signal Sel2 to the high level after detecting two rising edges of the feedback signal Fb2. Therefore, the dimming adjusting unit 270 increases the duty cycle of the control signal Sc2 according to the feedback signal Fb2. In contrast with the driving circuit of FIG. 1 and the corresponding waveforms as shown in FIG. 2, the inductor current IL2 of the present embodiment can be rapidly increased to reduce the decreased amount of the output voltage VOUT after the dimming signal DIM is changed from the second state, so as to prevent the problem of imprecise dimming control.

Figure 4A:
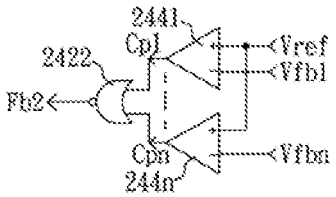
FIG. 4A is a circuit diagram of a voltage detecting circuit of FIG. 2 in accordance with a preferred embodiment of the present invention.

FIG. 4A is a circuit diagram of a voltage detecting circuit of FIG. 2 in accordance with a preferred embodiment of the present invention. The voltage detecting circuit comprises a plurality of comparators 2441-244*n* and a NOR gate 2422. The inverting inputs of the comparators 2441-244*n* are coupled to the corresponding current balancing ends D1-Dn, and the non-inverting inputs thereof are connected with each other for receiving a reference voltage Vref, and thus the comparators 2441-244*n* generate determination result signals Cp1-Cpn. When the voltage level of the corresponding current balancing end, is lower than the reference voltage Vref, the comparator outputs a high-level determined result signal. On the other hand, when the voltage level of the corresponding current balancing end is higher than the reference voltage Vref, the comparator outputs a low-level determined result signal. The NOR gate 2422 is coupled to output ends of the comparator 2441-244*n* and generates the feedback signal Fb2 according to the determination result signal Cp1-Cpn. For example, when a voltage level of one or more current balancing ends is lower than the reference voltage Vref, the NOR gate 2422 outputs a low-level feedback signal Fb2.

Figure 4B:
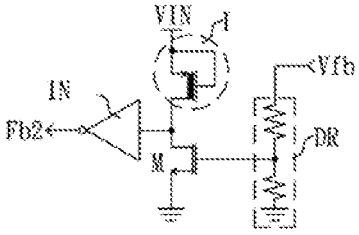
FIG. 4B is a circuit diagram of a detection circuit of FIG. 2 in accordance with a preferred embodiment of the present invention.

FIG. 4B is a circuit diagram of a detection circuit of FIG. 2 in accordance with a preferred embodiment of the present invention. The detection circuit comprises a switch M, a current source I and a waveform modulation circuit IN. The switch M is coupled with the current source I in series, and a control end of the switch M is coupled to a terminal of a corresponding current balance terminal. In the present embodiment, the control end of the switch M is coupled to the corresponding current balance terminal through a voltage divider DR. The voltage divider DR is used to adjust a level of the voltage signal Vfb, and thus the voltage dividing ratio thereof may be modulated, but the voltage divider DR may be omitted in an actual circuit. When the voltage signal Vfb is lower than the preset value, a voltage level of the control end of the switch M is lower than a threshold voltage, and thus the switch M is turned off. At this time, a voltage level of a connecting node between the switch M and the current source I is maintained at a high level. When the voltage signal Vfb is higher than the preset value, the voltage level of the control end of the switch M is higher than the threshold voltage, and thus the switch M is turned on. At this time, the voltage level of the connecting node between the switch M and the current source I is changed to a low level. In the present embodiment, the waveform modulation circuit IN is an inverter to enable a sharp waveform of the voltage level of the connecting node to generate the feedback signal Fb2. The current source I may be a depletion MOSFET (Metal-Oxide-Semiconductor Field-Effect Transistor) and a gate and a source thereof are connected with each other for compensating a temperature coefficient of the threshold voltage of the switch M.

Figure 6:
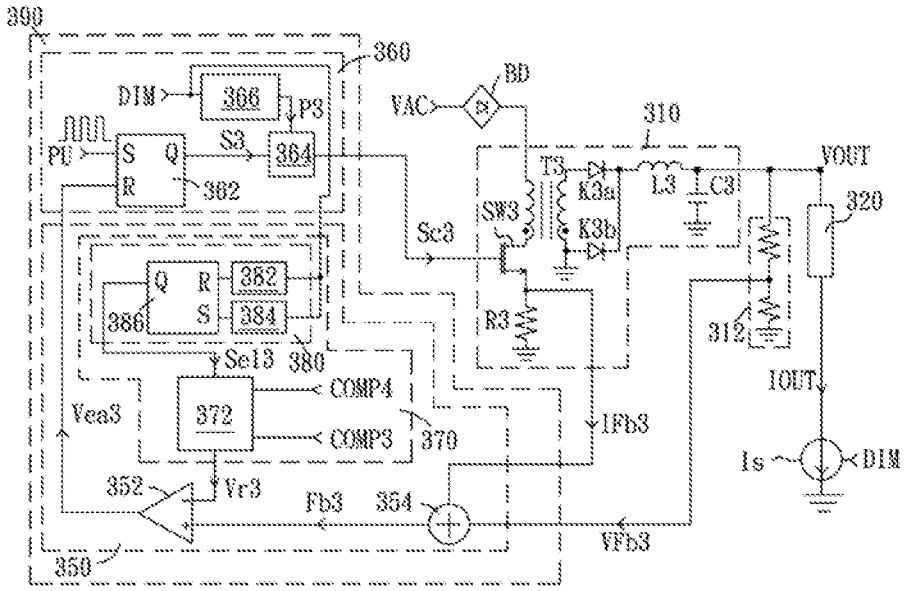
FIG. 6 is a circuit diagram of an LED driving circuit in accordance with a second preferred embodiment of the present invention.

FIG. 6 is a circuit diagram of an LED driving circuit in accordance with a second preferred embodiment of the present invention. The LED driving circuit includes a feedback control circuit 390 and a converting circuit 310, and is utilized for driving an LED module 320. The converting circuit 310 is coupled to an AC power source VAC through a bridge rectifier BD, and converts the power from the AC power source VAC to drive the LED module 320 according to a control signal Sc3. In the present embodiment, the converting circuit 310 is a forward converting circuit, which includes a transformer T3, a transistor SW3, rectifying diodes K3*a*, K3*b*, an inductor L3, and an output capacitor C3. One end of the primary side of the transformer T3 is coupled to the AC power source VAC, and the other end thereof is coupled to the transistor SW3. The transistor SW3 is also grounded through a resistor R3 so as to generate a current feedback signal IFb3. The output capacitor C3 is coupled to the secondary side of the transformer T3 through the rectifying diodes K3*a*, K3*b* and the inductor L3. A voltage detecting circuit 312 is coupled to the output capacitor C3 for generating a voltage feedback signal VFb3 representing the level of the output voltage VOUT. The LED module 320 is coupled to a current source to make the output current IOUT stabilized at a predetermined current value for generating steady illumination. The current source also receives a dimming signal DIM, and controls the on/off state of the current flowing through the LED module 320 according to the state of the dimming signal DIM. The dimming signal DIM is changed between a first state and a second state. When the dimming signal DIM is in the first state, a current with the predetermined current value is generated and flows through the LED module 320. When the dimming signal DIM is in the second state, the current is stopped from flowing through the LED module 320.

The feedback control circuit 390 includes a feedback unit 350 and a pulse width control unit 360, and is utilized to control the converting circuit 310 to convert the power of the AC power source VAC to drive the LED module 320. The feedback unit 350 includes a comparator 352, a signal added unit 354, and a dimming adjusting unit 370. The signal added unit 354 receives the current feedback signal IFb3 and the voltage feedback signal VFb3 so as to generate a feedback signal Fb3. The dimming adjusting unit 370 includes a selection unit 372 and a level adjusting unit 380. In the present embodiment, the level adjusting unit 380 includes a delay unit 382, a trigger unit 384, and a SR flip-flop 386. The trigger unit 384 is a rising edge-triggered one-shot circuit, which receives the dimming signal DIM and outputs a high level signal to the set input S of the SR flip-flop 386 right after the dimming signal DIM is changed from the second state to the first state. The delay unit 382 receives the dimming signal DIM and waits for a predetermined delay time since receiving the dimming signal DIM, and then, the delay unit 382 outputs a control signal to the reset input R of the SR flip-flop 386 to reset the SR flip-flop 386. The output Q of the SR flip-flop 386 outputs a selection signal Sel3 to the selection unit 372. When the selection signal Sel3 is at the low level, the selection unit 372 selects the first level signal COMP3 as the dimming adjusting signal Vr3, and when the selection signal Sel3 is at the high level, the selection unit 372 selects the second level signal COMP4, which has a level higher than that of the first level signal COMP3, as the dimming adjusting signal Vr3. The dimming adjusting signal Vr3 is then fed into the inverting input of the comparator 352, and the feedback signal Fb3 is fed into the non-inverting input of the comparator 352, such that the comparator 352 outputs a pulse signal as the pulse width control signal Vea3.

The pulse width control unit 360 includes a pulse width modulation unit 362 and a driving unit 364. The pulse width modulation unit 362 is a SR flip-flop, which has a set input S for receiving a clock signal PU and a reset input R for receiving the pulse width control signal Vea3. As the SR flip-flop 362 receives the clock signal PU at the set input S thereof, a pulse width modulation signal S3 is generated at the output Q, and is fed to the driving unit 364. In addition, a dimming control unit 366 generates a pulse dimming control signal P3 according to the dimming signal DIM. The operation of the dimming control unit 366 is substantially identical to the dimming control unit 266 in FIG. 2, and thus is not described herein again. The driving unit 364 receives both the pulse width modulation signal S3 and the dimming control signal P3. When the dimming signal DIM is in the first state, the driving unit 364 generates the control signal Sc3 according to the pulse width modulation signal S3. When the dimming signal DIM is in the second state, the driving unit 364 generates the control signal Sc3 according to the dimming control signal P3. It is noted that in a predetermined period right after the dimming signal DIM is changed from the second state to the first state, the dimming adjusting unit 370 changes the output signal to the inverting input of the comparator 352 from the first level signal COMP3 to the second level signal COMP4 for adjusting a level of the pulse width control signal Vea3, so as to increase the duty cycle of the control signal Sc3 instantly. Thus, the inductor current flowing through the inductor L3 is rapidly increased to reduce the amount of level reduction of the output voltage VOUT, so as to improve the problem of imprecise dimming control for the LED module 320 as the dimming signal DIM is changed from the second state to the first state.

Figure 7:
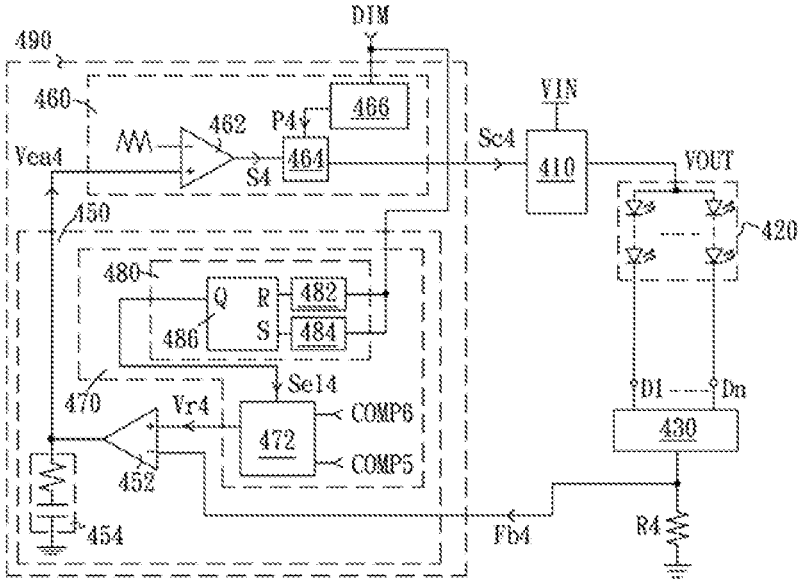
FIG. 7 is a circuit diagram of an LED driving circuit in accordance with a third preferred embodiment of the present invention.

FIG. 7 is a circuit diagram of an LED driving circuit in accordance with a third embodiment of the present invention. The LED driving circuit includes a feedback control circuit 490 and a converting circuit 410, and is utilized for driving an LED module 420. The feedback control circuit 490 receives a feedback signal Fb4 for feedback control, and generates a control signal Sc4 to control the converting circuit 410. The input of the converting circuit 410 is coupled to an input power source VIN, and the output of the converting circuit 410 is coupled to the LED module 420 for outputting an output voltage VOUT to drive the LED module 420 with a plurality of LED strings connected in parallel. In addition, to make sure an identical steady current flowing through each LED units of the LED module 420, a current balancing unit 430 may be used in the LED driving circuit of the present embodiment. The current balancing unit 430 has a plurality of current balancing ends D1-Dn. Each of the current balancing ends D1-Dn is coupled to the corresponding LED string in the LED module 420 so as to balance the current of each of the LED strings. The current flowing through the LED strings also generates the feedback signals Fb4 by flowing through a current detecting resistor R4.

The feedback control circuit 490 includes a feedback unit 450 and a pulse width control unit 460. The feedback unit 450 includes an amplifying unit 452, a compensation unit 454, and a dimming adjusting unit 470. The dimming adjusting unit 470 includes a selection unit 472 and a level difference generating unit 480. In the present embodiment, the level difference generating unit 480 includes a delay unit 482, a trigger unit 484, and a SR flip-flop 486. The trigger unit 484 is a rising edge-triggered one-shot circuit, which receives a dimming signal DIM, and outputs the high level signal to the set input S of the SR flip-flop 486 right after the dimming signal DIM is changed from the second state to the first state. The delay unit 482 receives the dimming signal DIM, and waits for a predetermined delay time after receiving the dimming signal DIM, and then outputs a control signal to the reset input R of the SR flip-flop 486 so as to reset the SR flip-flop 486. The SR flip-flop 486 outputs a selection signal Sel4 to the selection unit 472 from the output Q. When the selection signal Sel4 is at the low level, a first level signal COMP5 is selected for generating a dimming adjusting signal Vr4; and when the selection signal Sel4 is at the high level, a second level signal COMP6, which has a level higher than that of the first level signal COMP5, is selected for generating a dimming adjusting signal Vr4.

In contrast with the driving circuit of FIG. 6, the amplifying unit 452 in accordance with the present embodiment has a non-inverting input for receiving the dimming adjusting signal Vr4 and the inverting input for receiving the feedback signal Fb4, so as to generate an error signal. In addition, the driving circuit of the present embodiment has a compensation unit 454, which includes a capacitor and a resistor. The relationship between the voltage gain and frequency of the compensation unit 454 may be adjusted for the application circuits, so as to improve transient response of the feedback control circuit 490.

The pulse width control unit 460 includes a pulse width modulation unit 462, a dimming control unit 466, and a driving unit 464, and controls the duty cycle of the control signal Sc4 according to the pulse width control signal Vea4. The pulse width modulation unit 462 may be a comparator, which has a non-inverting input for receiving the pulse width control signal Vea4 and an inverting input for receiving a ramp signal, so as to generate and output a pulse width modulation signal S4 to the driving unit 464. The dimming control unit 466 generates a pulse dimming control signal P4 according to the dimming signal DIM. The operation of the dimming control unit 466 is substantially identical to the dimming control unit 266 of FIG. 2, and thus is not described herein again. The driving unit 464 receives the pulse width modulation signal S4 and the dimming control signal P4. When the dimming signal DIM is in the first state, the driving unit 464 generates the control signal Sc4 according to the pulse width modulation signal S4; and when the dimming signal DIM is in the second state, the driving unit 464 generates the control signal Sc4 according to the dimming control signal P4. It is noted that, within a period right after the dimming single DIM is changed from the second state to the first state, the output signal of the dimming adjusting unit 470 is changed from the first level signal COMP5 to the second level signal COMP6, which shows an increase with a predetermined level. The comparator 452 adjusts the level of the pulse width control signal Vea4 according to the output signal of the selection unit 472 received at the non-inverting input, so as to increase the duty cycle of the control signal Sc4 rapidly to quickly increase the inductor current IL to reduce the amount and the time of level reduction of the output voltage VOUT. Thus, the problem of imprecise dimming control for the LED module 420 right after the dimming signal DIM is changed from the second state to the first state can be improved.

Figure 8:
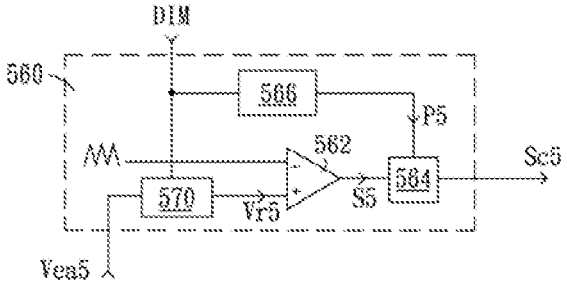
FIG. 8 is a circuit diagram of an LED driving circuit in accordance with a fourth preferred embodiment of the present invention.

FIG. 8 is a circuit diagram of a pulse width control unit in accordance with a fourth preferred embodiment of the present invention. The pulse width control unit 560 includes a pulse width modulation unit 562, a driving unit 564, and a dimming control unit 566. With respect to the pulse width control unit 260 in FIG. 2, the dimming control unit 560 may include a dimming adjusting unit 570 for adjusting the duty cycle of a control signal Sc5. As shown in FIG. 8, the dimming adjusting unit 570 receives the pulse width control signal Vea5 and the dimming signal DIM, and adjusts a level of the pulse width control signal Vea5 according to the dimming signal DIM so as to generate a dimming adjusting signal Vr5. In the present embodiment, the dimming signal DIM is changed between a first state and a second state. The dimming adjusting signal Vr5 outputted to the pulse width modulation unit 562 is raised by a predetermined level within a period right after the dimming signal DIM is changed from the second state to the first state. In contrast, the dimming adjusting unit 570 directly outputs the pulse width control signal Vea5 as the dimming adjusting signal Vr5 without any modification in the other conditions, such as in the time period with respect to the continuation of the first state or in the time period with respect to the continuation of the second state. The pulse width modulation unit 562 has an inverting input for receiving a ramp signal and a non-inverting input for receiving the dimming adjusting signal Vr5, so as to generate and output a pulse width modulation signal S5 to the driving unit 564. The dimming control unit 566 generates a pulse dimming control signal P5 according to the dimming signal DIM. The operation of the dimming control unit 566 is substantially identical to the dimming control unit 266 of FIG. 2 and thus is not described herein again. The driving unit 564 receives both the pulse width modulation signal S5 and the dimming control signal P5. When the dimming signal DIM is in the first state, the driving unit 564 generates the control signal Sc5 according to the pulse width modulation signal S5. When the dimming signal DIM is in the second state, the driving unit 564 generates the control signal according to the dimming control signal P5. It is noted that, within a predetermined period right after the dimming signal DIM is changed from the second state to the first state, the pulse width of the pulse width modulation signal S5 is increased by a predetermined width, such that the duty cycle of the control signal Sc5 is increased by a predetermined value to enhance the output power of the converting circuit rapidly. Thus, the problem of imprecise dimming control for the LED module right after the dimming signal DIM is changed from the second state to the first state can be improved.

Figure 9:
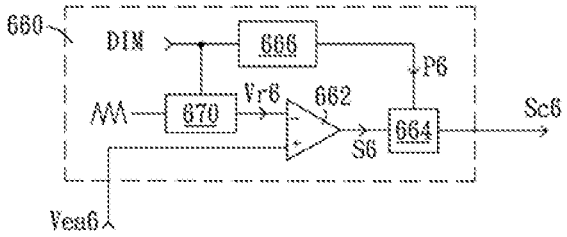
FIG. 9 is a circuit diagram of a pulse width control unit in an LED driving circuit in accordance with a fifth preferred embodiment of the present invention.
Figure 10:
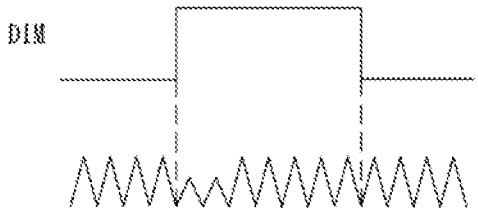
FIG. 10 is a diagram of waveforms showing the signals related to dimming control of the pulse width control unit in FIG. 9 operated by using a ramp wave.

FIG. 9 is a circuit diagram of a pulse width control unit in accordance with a fifth embodiment of the present invention. The pulse width control unit 660 includes a pulse width modulation unit 662, a driving unit 664, and a dimming control unit 666. In contrast with the pulse width control unit 260 of FIG. 2, the pulse width control unit 660 may include a dimming adjusting unit 670 for adjusting the duty cycle of a control signal Sc6. The dimming adjusting unit 670 receives a ramp signal, and generates a dimming adjusting signal Vr6 according to the timing of the dimming signal DIM, and the dimming signal DIM is changed between a first state and a second state. Also referring to FIG. 10, the dimming adjusting unit 670 reduces a peak value of a predetermined number of cycles of the ramp signal within a period right after the dimming signal DIM is changed from the second state to the first state, so as to generate the dimming adjusting signal Vr6 outputted to the pulse width modulation unit 662. That is, the amplitude of the predetermined number of cycles of the ramp signal is reduced. In the other conditions, such as in the period in which the first state continues or in the period in which the second state continues, the dimming adjusting unit 670 merely delivers the ramp signal as the dimming adjusting signal Vr6 to the pulse width modulation unit 662. The pulse width modulation unit 662 has an inverting input for receiving the dimming adjusting signal Vr6 and a non-inverting input for receiving a pulse width control signal Vea6, and outputs a pulse width modulation signal S6 to the driving unit 664. The dimming control unit 666 generates a pulse dimming control signal P6 according to the dimming signal DIM. The operation of the dimming control unit 666 is substantially identical to the dimming control unit 266 of FIG. 2 and thus is not described herein again. The driving unit 664 receives both the pulse width modulation signal S6 and the dimming control signal P6. When the dimming signal DIM is in the first state, the driving unit 664 generates the control signal Sc6 according to the pulse width modulation signal S6; and when the dimming signal DIM is in the second state, the driving unit 664 generates the control signal Sc6 according to the dimming control signal P6. The pulse width of the pulse width modulation signal S6 is increased by a predetermined width to increase the duty cycle of the control signal Sc6 by a predetermined value, so as to enhance the output power of the converting circuit within a period right after the dimming signal DIM is changed from the second state to the first state. Thus, the problem of imprecise dimming control for the LED module right after the dimming signal DIM is changed from the second state to the first state can be improved.

Figure 11:
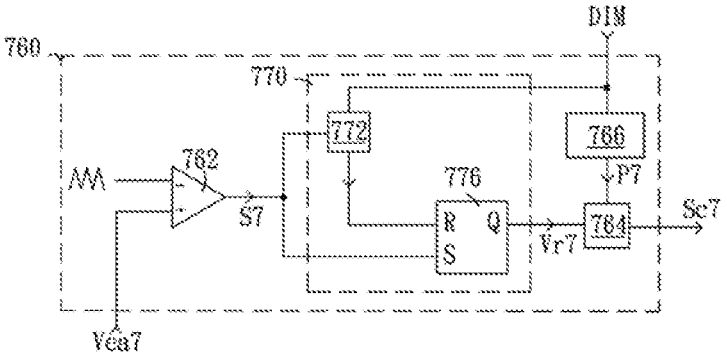
FIG. 11 is a circuit diagram of a pulse width control unit in an LED driving circuit in accordance with a sixth preferred embodiment of the present invention.

FIG. 11 is a circuit diagram of a pulse width control unit in accordance with a sixth embodiment of the present invention. The pulse width control unit 760 includes a pulse width modulation unit 762, a driving unit 764, and a dimming control unit 766. In contrast with the pulse width control unit 260 of FIG. 2, the pulse width control unit 760 may have a dimming adjusting unit 770 for adjusting the duty cycle of a control signal Sc7. The pulse width modulation unit 762 has an inverting input for receiving a ramp signal and a non-inverting input for receiving a pulse width control signal Vea1, and outputs a pulse width modulation signal S7 to the dimming adjusting unit 770. The dimming adjusting unit 770 includes a delayed trigger unit 772 and a SR flip-flop 776. The delayed trigger unit 772 is coupled to the pulse width modulation unit 762. Within a period right after the dimming signal is changed from the second state to the first state, the delayed trigger unit 772 generates a pulse signal to the reset input R of the SR flip-flop 776 in a predetermined time after detecting the falling edge of the pulse width modulation signal S7. Thus, the dimming adjusting signal Vr7 generated by the dimming adjusting unit 770 has a pulse width greater than that of the pulse width modulation signal S7 within a period right after the dimming signal is changed from the second state to the first state. The dimming control unit 766 generates a pulse dimming control signal P7 according to the dimming signal DIM. The operation of the dimming control unit 766 is substantially identical to the dimming control unit 266 in FIG. 2 and thus is not described herein again. The driving unit 764 receives both the dimming adjusting signal Vr7 and the dimming control signal P7. The dimming signal DIM is changed between a first state and a second state. When the dimming signal DIM is in the first state, the driving unit 764 generates the control signal Sc7 according to the dimming adjusting signal Vr7. When the dimming signal DIM is in the second state, the driving unit 764 generates the control signal Sc7 according to the dimming control signal P7. It is noted that, the pulse width of the dimming adjusting signal Vr7 is increased by a predetermined width to increase the duty cycle of the control signal Sc7 by a responded predetermined value, so as to enhance the output power of the converting circuit rapidly to reduce the time and the amount of level reduction of the output voltage. Thus, the problem of imprecise dimming control for the LED module right after the dimming signal DIM is changed from the second state to the first state can be improved.

While the preferred embodiments of the present invention have been set forth for the purpose of disclosure, modifications of the disclosed embodiments of the present invention as well as other embodiments thereof may occur to those skilled in the art. Accordingly, the appended claims are intended to cover all embodiments which do not depart from the spirit and scope of the present invention.

What is claimed is:

1. An LED (Light-Emitting Diode) driving control circuit for controlling a converting circuit to convert a power from a power source into an output voltage to drive an LED module which has a plurality of LED strings, the LED driving control circuit comprising:

a voltage detecting circuit comprising a plurality of detection circuits, wherein each of the detection circuits is coupled to a terminal of a corresponding LED string in the LED module for determining whether the terminal is higher than or lower than a preset value, thereby generating a determination result, and each of the detection circuits generates a feedback signal in response to the determination result; and a feedback control circuit controlling the converting circuit to modulate the output voltage according to the feedback signal, wherein each of the detection circuit comprises a switch, a current source and a waveform modulation circuit, and the switch is coupled with the current source in series, and a control end of the switch is coupled to the terminal of the corresponding LED string, and an input end of the waveform modulation circuit is coupled to a connecting node between the switch and the current source and generates the feedback signal at a first logical level or a second logical level in response to that a state of the switch.

2. The LED driving control circuit of claim 1, wherein the feedback control circuit comprises:

a feedback unit which comprises a charging unit, a discharging unit, and a capacitor, and generates a pulse width control signal in response to a voltage of the capacitor, wherein the charging unit is coupled to the capacitor for charging the capacitor; the discharging unit is coupled to the capacitor for discharging the capacitor; and one of the charging unit and the discharging unit is activated when a voltage of one or more terminals of the LED strings coupled to the voltage detecting circuit is lower than the preset value, and the other of the charging unit and the discharging unit is activated when the voltages of all the terminals of the LED strings coupled to the voltage detecting circuit are higher than the preset value; and a pulse width control unit for generating at least one control signal according to the pulse width control signal for controlling the converting circuit to perform power conversion operation.

3. The LED driving control circuit of claim 2, wherein the voltage detecting circuit further comprises a logical unit, and the detection circuits are comparators, and each of the comparators generates a comparison result signal in response to a voltage detection signal indicative of a voltage of the terminal of the corresponding LED string coupled thereto and a reference signal indicative of the preset value, and the logical unit generates the feedback signal at a first logical level or a second logical level in responsive to the comparison result signals.

4. The LED driving control circuit of claim 2, wherein each of the detection circuit comprises a switch, a current source and a waveform modulation circuit, and the switch is coupled with the current source in series, and a control end of the switch is coupled to the terminal of the corresponding LED string, and an input end of the waveform modulation circuit is coupled to a connecting node between the switch and the current source and generates the feedback signal at a first logical level or a second logical level in response to that a state of the switch.

5. The LED driving control circuit of claim 4, wherein the waveform modulation circuit is an inverter.

6. The LED driving control circuit of claim 4, wherein the current source is a depletion MOSFET (Metal-Oxide-Semiconductor Field-Effect Transistor).

7. The LED driving control circuit of claim 1, wherein the voltage detecting circuit further comprises a logical unit, and the detection circuits are comparators, and each of the comparators generates a comparison result signal in response to a voltage detection signal indicative of a voltage of the terminal of the corresponding LED string coupled thereto and a reference signal indicative of the preset value, and the logical unit generates the feedback signal at a first logical level or a second logical level in responsive to the comparison result signals.

8. The LED driving control circuit of claim 1, wherein the waveform modulation circuit is an inverter.

9. The LED driving control circuit of claim 1, wherein the current source is a depletion MOSFET.

10. An LED driving circuit adapted for driving an LED module which has a plurality of LED strings, the LED driving circuit comprising:

a converting circuit coupled to the LED module for receiving at least one control signal to convert an input voltage into an output voltage to drive the LED module;

a current balance unit coupled to the LED strings for balancing currents of the LED strings; and an LED driving control circuit comprising a plurality of detection circuits, wherein each of the detection circuits is coupled to a terminal of a corresponding LED string for determining whether the terminal is higher or lower than a preset value, and for generating the at least one control signal for controlling the converting circuit to modulate the output voltage, wherein each of the detection circuits comprises a switch, a current source and a waveform modulation circuit, and the switch is coupled with the current source in series, and a control end of the switch is coupled to the terminal of the corresponding LED string, and an input end of the waveform modulation circuit is coupled to a connecting node between the switch and the current source and generates a feedback signal at a first logical level or a second logical level in response to the a state of the switch

11. The LED driving circuit of claim 10, wherein the LED driving control circuit further comprises a logical unit, and the detection circuits are comparators, wherein each of the comparators generates a comparison result signal in response to a voltage detection signal indicative of a voltage of the terminal of the corresponding LED string coupled thereto and a reference signal indicative of the preset value, and the logical unit generates a feedback signal at a first logical level or a second logical level in responsive to the comparison result signals.

12. The LED driving circuit of claim 11, wherein the LED driving control circuit further comprises:

a feedback unit which comprises a charging unit, a discharging unit, and a capacitor, and generates a pulse width control signal in response to a voltage of the capacitor, wherein the charging unit is coupled to the capacitor for charging the capacitor; the discharging unit is coupled to the capacitor for discharging the capacitor; and one of the charging unit and the discharging unit is activated when a voltage of one or more terminals of the LED strings coupled to the voltage detecting circuit is lower than the preset value, and the other of the charging unit and the discharging unit is activated when the voltages of all the terminals of the LED strings coupled to the voltage detecting circuit are higher than the preset value; and a pulse width control unit for generating the at least one control signal according to the pulse width control signal for controlling the converting circuit to perform power conversion operation.

13. The LED driving circuit of claim 10, wherein the LED driving control circuit further comprises:

a feedback unit which comprises a charging unit, a discharging unit, and a capacitor; and generates a pulse width control signal in response to a voltage of the capacitor, wherein the charging unit is coupled to the capacitor for charging the capacitor; the discharging unit is coupled to the capacitor for discharging the capacitor; and one of the charging unit and the discharging unit is activated when a voltage of one or more terminals of the LED strings coupled to the voltage detecting circuit is lower than the preset value, and the other of the charging unit and the discharging unit is activated when the voltages of all the terminals of the LED strings coupled to the voltage detecting circuit are higher than the preset value; and a pulse width control unit for generating the at least one control signal according to the pulse width control signal for controlling the converting circuit to perform power conversion operation.

14. The LED driving circuit of claim 10, wherein the waveform modulation circuit is an inverter.

15. The LED driving circuit of claim 14, wherein the LED driving control circuit further comprises:

a feedback unit which comprises a charging unit, a discharging unit, and a capacitor; and generates a pulse width control signal in response to a voltage of the capacitor, wherein the charging unit is coupled to the capacitor for charging the capacitor; the discharging unit is coupled to the capacitor for discharging the capacitor; and one of the charging unit and the discharging unit is activated when a voltage of one or more terminals of the LED strings coupled to the voltage detecting circuit is lower than the preset value, and the other of the charging unit and the discharging unit is activated when the voltages of all the terminals of the LED strings coupled to the voltage detecting circuit are higher than the preset value; and a pulse width control unit for generating the at least one control signal according to the pulse width control signal for controlling the converting circuit to perform power conversion operation.

* * * * *